US008225864B2

(12) United States Patent
Angman

(10) Patent No.: US 8,225,864 B2
(45) Date of Patent: Jul. 24, 2012

(54) WELL STRING CENTRALIZER AND METHOD OF FORMING

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 382 days.

(21) Appl. No.: 11/961,642

(22) Filed: Dec. 20, 2007

(65) Prior Publication Data

US 2008/0164019 A1 Jul. 10, 2008

Related U.S. Application Data

(60) Provisional application No. 60/888,150, filed on Feb. 5, 2007, provisional application No. 60/871,072, filed on Dec. 20, 2006.

(51) Int. Cl.
*E21B 17/10* (2006.01)

(52) U.S. Cl. ..... 166/241.6; 166/241.1; 175/325.5

(58) Field of Classification Search ..... 166/241.6, 166/241.7, 241.1; 175/325.5
See application file for complete search history.

(56) References Cited

U.S. PATENT DOCUMENTS

| | | | | |
|---|---|---|---|---|
| 2,318,878 | A | 5/1943 | Miller | |
| 2,715,552 | A | 8/1955 | Lane | |
| 3,145,785 | A * | 8/1964 | Kellner | 175/73 |
| 3,420,323 | A * | 1/1969 | Owens | 175/323 |
| 3,480,094 | A | 11/1969 | Morris | |
| 3,961,674 | A * | 6/1976 | Craig et al. | 175/325.2 |
| 4,938,299 | A * | 7/1990 | Jelsma | 175/73 |
| 5,833,019 | A | 11/1998 | Gynz-Rekowski | |
| 5,908,072 | A * | 6/1999 | Hawkins | 166/241.6 |
| 6,032,748 | A | 3/2000 | DeBray et al. | |
| 6,513,223 | B1 | 2/2003 | Angman et al. | |
| 7,409,758 | B2 * | 8/2008 | Le et al. | 29/421.1 |
| 2003/0164236 | A1 * | 9/2003 | Thornton | 166/278 |
| 2005/0092527 | A1 * | 5/2005 | Le et al. | 175/325.6 |
| 2009/0260802 | A1 * | 10/2009 | Ernst et al. | 166/241.3 |

* cited by examiner

*Primary Examiner* — Jennifer H Gay
*Assistant Examiner* — Elizabeth Gottlieb
(74) *Attorney, Agent, or Firm* — Bracewell & Giuliani LLP

(57) ABSTRACT

Centralizer includes a body formed of a first material and an outer shell formed of a second material. The outer shell is installed to resist destructive damage and longitudinal creep of the portion formed of the first material. The outer shell covers the entire exterior surface of the body, including ribs that protrude from the exterior surface. The outer shell material is more durable than the material of the body. The outer shell material may be steel and the body material may be a polymer. The ribs and exterior surface of the body bond to the outer shell. The centralizers fit on well pipes to centralize them within boreholes.

4 Claims, 3 Drawing Sheets

WELL STRING CENTRALIZER AND METHOD OF FORMING

FIELD

The present invention relates to downhole tools and, in particular, downhole well string centralizers.

BACKGROUND

Well strings such as drill strings, production strings, drive strings, etc. are used in borehole operations. During such operations, it may be useful or necessary to centralize the well string to prevent it from wearing against or sticking to the borehole wall, to ensure an annular space is maintained between the well string and the borehole wall, etc. Centralizers, which are sometimes alternately termed stabilizers, have been used to effect such centralization. Centralizers generally each include an axial bore and an outer surface and are installed to encircle the wellstring with a portion of the well string extending through the bore of the centralizer.

Plastic centralizers are known. Some plastic centralizers have suffered from damage at their ends where the centralizer is acted on by the formation and the casing about which it is installed. To address the end-wise damage of the centralizers, metal rings have been installed as by securing to or imbedding in the ends of some centralizers. Metal rings are intended to provide reinforcement, stabilization and enhanced durability at the ends of the centralizer, where it often undergoes greater stresses as by abutment against borehole ledges, other string components such as collars, shoulders, rings, etc. However, such rings have in some cases become detached from the plastic part of the centralizer or the plastic material of the centralizer has become deformed to ride up over the ring or broken apart entirely.

SUMMARY

According to one aspect of the present invention, there is provided a centralizer comprising: a body including an exterior surface, a plurality of ribs extending radially outwardly from the exterior surface, a bore extending though the body, a first end and a second end, the first and second ends extending circumferentially about the bore; the body further including a first body portion including an outer facing surface and an inner facing surface defining the bore, the first body portion being formed of a first material; and an outer shell secured over at least a portion of the outer facing surface of the first body portion, the outer shell formed of a second material more durable than the first material.

According to another aspect of the present invention, there is provided a wellstring assembly comprising: a tubular section and; a tubular device including a bore therethrough, the tubular device installed on the tubular section with the tubular section extending through the bore, the tubular device further including: a body including an exterior surface, a plurality of ribs extending radially outwardly from the exterior surface, a first end and a second end, the first and second ends extending circumferentially about the bore; the body further including a first body portion including an outer facing surface and an inner facing surface defining the bore, the first body portion being formed of a first material; and an outer shell secured over at least a portion of the outer facing surface of the first body portion, the outer shell formed of a second material more durable than the first material.

According to another aspect of the present invention, there is provided a method for manufacturing a centralizer, the method comprising: providing an outer shell defining an outer surface contour of the centralizer; providing a mold jig including a central mandrel; positioning the outer shell concentrically about the central mandrel to form an annular space therebetween; introducing a polymer in liquid form to the annular space; and allowing the polymer to set to form the centralizer, wherein the polymer, when set forms a first body portion with the outer shell attached thereto and overlying at least a portion of the first body portion.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1:
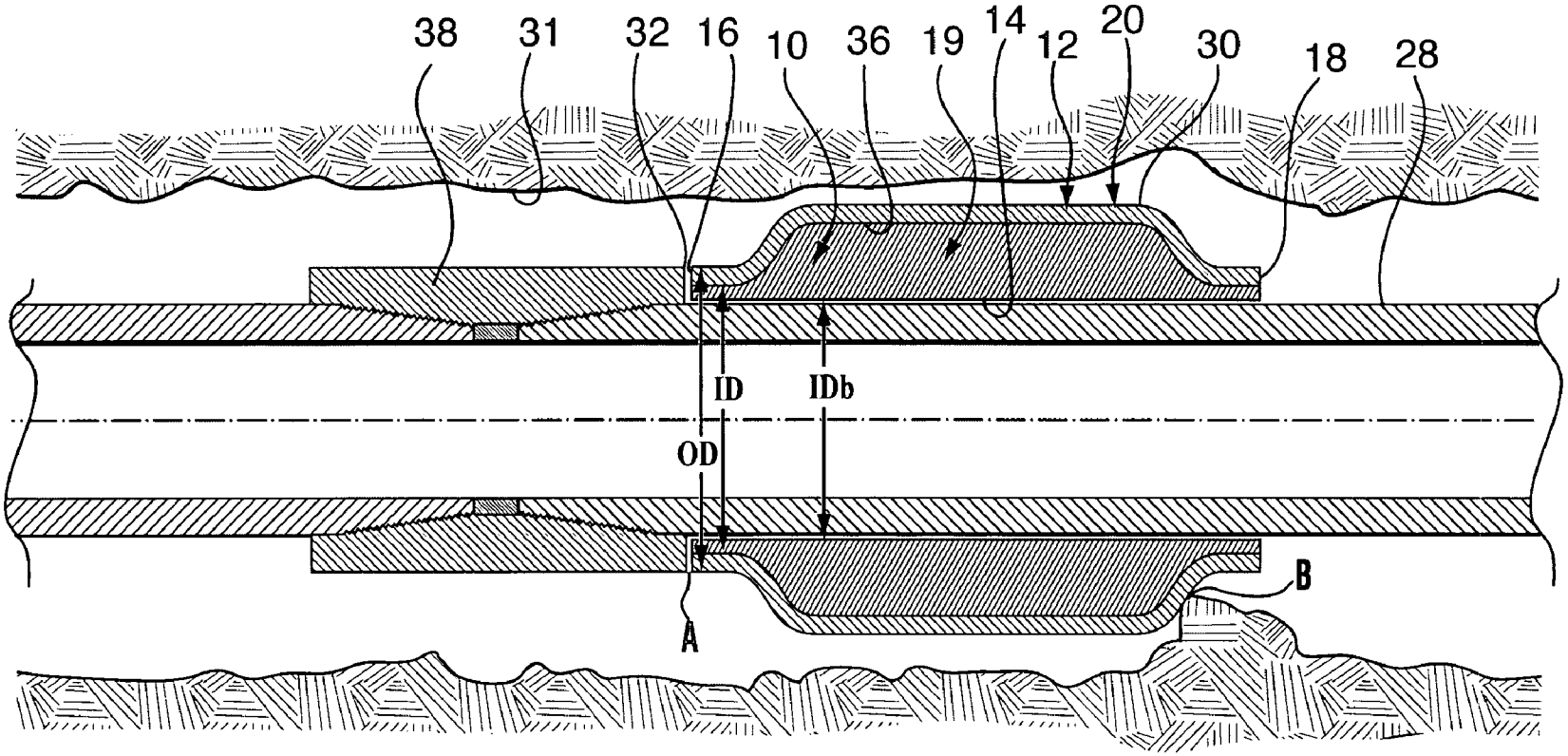
FIG. 1 is a sectional view through a wellstring assembly in a wellbore, the wellstring assembly including a well string tubular segment and a centralizer according to one aspect of the present invention.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Centralizers are described herein including at least a first portion formed of a first material and at least a second portion secured to the first portion and formed of a second material, more durable than the first material. The second portion being installed to resist longitudinal creep and destructive wear of the first portion.

According to one aspect, a centralizer 10 includes a body 12 with a bore 14 extending between a first end 16 and a second end 18. The first and second ends extend circumferentially defining openings to bore 14.

Centralizer body may be formed of at least two parts. For example, centralizer body may include a first portion formed of a first material and a second portion formed of a second material, secured at least in part to the first portion. In the illustrated embodiment, the first portion includes an inner body 19 and the second portion includes an outer shell 20.

As will be appreciated, the centralizer may be formed to be retained over a well string tubular 28, such as drill pipe or casing including various kinds of tubulars, casing joints, liners, screens, etc. The centralizer may be formed to be rotating or substantially non-rotating on the tubular after installation. In the present embodiment, bore 14 fit over the wellbore tubular such that the centralizer is stable but able to rotate thereon. This, therefore, allows the centralizer to be substantially non-rotating relative to the borehole wall, as the casing can rotate within the centralizer. Centralizer 10 may be formed to be handled as one piece or may be formed in sections for assembly to form the centralizer. In one embodiment, the body is continuous about the bore and the centralizer is retained over wellbore tubular 28 by insertion of the tubular through the bore.

An inner-facing surface defining bore 14 and an outer surface opposite the inner facing surface may be defined on the centralizer body. The outer surface may include ribs 30 formed as straight, helical, elongate, etc., vanes, protrusions, etc., as desired, to control flow therepast or to select wear, bearing or spacing properties relative to the formation and/or borehole in which the centralizer is to be used. The outer surface is formed at least to allow the centralizer to provide positive stand off of tubular 28 from the formation wall 31 defining the borehole.

In the embodiment of FIG. 1, outer shell 20 extends to define at least in part the outer surface. Outer shell 20 is formed of the second material, which is more durable than the material forming inner body 19. As such, outer shell 20 is intended to reinforce, cover and protect at least a portion of the inner body of the centralizer from damage by impact against borehole wall 30, indicated at B, and/or by impact against structures on the casing such as the coupling shoulder 32, indicated at A. The material of the outer shell, termed herein the second material, may have a hardness, strength, durability, or stiffness greater than any or all of those characteristics of the first material, which is the material forming the centralizer inner body 19. In one embodiment, the second material may be described as having a Young's modulus greater than that of the first material. For example, the first material may have a Young's modulus of 550,000 to 1,000,000 psi, while the second material may have a Young's modulus of greater than 10,000,000 psi. In one embodiment, the second material may include a metal such as various forms of bronze, steel, etc. In one embodiment, cold formed steel may be useful as it does not require heat treatment after forming.

The first material may include one or more of a rubber, an elastomer, a ceramic, a cermet, a carbide, a soft metal (i.e. aluminum), a polymeric material such as a plastic, etc. that is durable and able to operate for at least a period in wellbore conditions. Of course the materials may include reinforcements, fillers, etc. As will be appreciated, to be useful to form a centralizer for use in wellbore operations, the material may be durable enough to withstand contact with wellbore fluids and wear and tear, without complete destruction thereof. For example, the material may be able to withstand to some degree, wellbore conditions for periods of time normally encountered for use of a drill string, for running or drilling in a liner string, and/or for residence time between installation of a wellstring and completion of a wellbore. Examples of materials particularly suitable to form a centralizer body are well known in the art of "plastic centralizers", such as for example polyurethane, polyphthalamide, aliphatic polyketone, nylon, polyamide, and/or various other thermoplastics.

The outer shell may be positioned to create the centralizer outer surface where it is desired to protect and reinforce the inner body. The inner body has low strength but may be protected by the outer shell. For example, the outer shell may be positioned to reinforce an end of the centralizer so that the centralizer resists deformation and damage at that end. Alternately or in addition, the outer shell may be positioned to extend over one or more ribs 30 on the outer surface, the ribs being portions of the centralizer that can experience relatively greater wear than some other portions of the centralizer. In one embodiment, the outer shell is a one piece structure, rather than a plurality of independent parts, that extends over any portion of the outer surface which is selected to be protected. In one embodiment, for example, the outer shell encircles the first opening to the axial bore and extends to cover the ribs of the centralizer, such that the portion of the shell encircling the bore and the portions covering the ribs is a one-piece, integrally formed structure. The outer shell may have properties including hoop strength by forming the shell to be a continuous ring, to encircle the centralizer at points where protection is sought i.e. encircle one or both ends and/or encircle the body about the ribs. In one embodiment, the outer shell covers substantially the entire outer surface of the centralizer between first end 16 and second end 18, leaving only the bore and a possibly a small surface area adjacent the bore open.

Outer shell 20 may have a substantially uniform wall thickness over the entire expanse of the outer shell, such that the inner surface 36 of the outer shell follows the external surface curvature. In such an embodiment, for example, indentations are formed in the outer shell inner surface 36 behind the protrusions forming ribs 30. The thickness of the outer shell should be selected with consideration to the material of the outer shell and its wear properties to be able to withstand wear and tear, substantially without complete destruction thereof. For example, the material may be able to withstand to some degree, impact and wear for periods of time normally encountered for use of a drill string and/or for running or drilling in a liner string without completely wearing through, or at least without complete failure/removal thereof. In one embodiment, the outer shell may be 1/16 inch to 1/2 inch thick and in one embodiment be about 3/32 to 5/32 inch thick.

As noted previously, the outer shell protects the less durable material of the inner body. During wellstring handling and use, much damage can occur where the centralizer impacts against a shoulder 32 on the casing. It is, therefore, desirable to form the outer shell to protect the inner body against such direct impact. Thus, the outer shell may be formed and positioned on the outer body with consideration as to size and position of any casing shoulders against which a centralizer is likely to come into contact. In an application where the centralizer is used on a wellbore casing string, a shoulder 32 is formed at the coupling 38 end face. In one embodiment, the outer shell is selected to include an inner diameter ID at its end which is less than the outer diameter of the coupling so that the outer shell overlaps at least in part with the coupling. In this way, should the centralizer during use come into contact with coupling 38, the outer shell can take up the force of that contact and prevent or reduce damage to inner body 19. Of course, if the inner body extends out axially beyond the outer shell, the outer shell will only come into contact with the coupling once the material of the inner body is worn away, but thereafter will resist further degradation of the inner body from impact against the coupling. The sizes of casing and their corresponding couplings are controlled by the API Specifications (API Specification 5CT, Sixth Edition, October 1998). For example, according to the standards, a 7 inch casing uses a standard coupling of OD 7.656 inches and a 9⅝ inch casing uses a standard casing coupling of OD 10.625 inches. As such, it is possible to produce centralizers that work with the various standard casing sizes. For example, in one embodiment, for use with 7 inch casing, a centralizer may be provided having a bore 14 with an inner diameter IDb of approximately 7 inches (i.e. 6.9 to 7.2 inches) and an outer shell with a minimum ID at least its usual coupling compact end of less than 7.656 inches. In order to reduce fluid drag effects over the interface between the coupling and the centralizer, it may be useful to form such a centralizer with an outer shell outer diameter at its end of approximately equal to or less than the coupling outer diameter (i.e. an outer shell OD at its end less than 7.656 inches for standard 7 inch casing). For use on a 9⅝ inch casing, a centralizer with an outer shell ID and possibly also an OD at its coupling contact end of less than 10.625 inches. Of course, the centralizer OD at the ribs will be greater than the coupling OD to allow a positive stand off of the coupling from the formation wall. In some embodiments, it may be desirable to limit contact of the outer shell with the wellstring tubular on which the centralizer is mounted to avoid concerns regarding wear, if any. In such an embodiment, the inner diameter ID of outer shell may be greater than the inner diameter of bore 14.

Outer shell 20 may be formed in various ways at its ends. In one embodiment, the ends are axially straight (non-tapered). In another embodiment, the ends are radially tapered, as by crimping, rolling, bending, forming, milling, etc. Such an end treatment may allow a selection of the end inner diameter to circumferentially overlap a casing shoulder 32 and/or to form a surface that contacts the casing shoulder in a selected way. Also, such an end treatment may reinforce the end of the outer shell and bias the outer shell toward deformation inwardly preferentially over allowing deformation outwardly, which might cause the outer shell to flay out and ride over the coupling.

In one embodiment, a reinforcing end ring may be connected to the outer shell to reinforce the outer shell at one or both of its ends. Any such ring may be constructed and installed with a view to the inner and outer diameter considerations noted above. The ring may, for example be thicker than the material of the outer shell. The ring may be secured at the end of the outer shell by various processes such as frictional engagement, threading, welding, etc.

The outer shell may be selected to form a smooth outer curvature substantially without abrupt surface contour changes, such that the formation of abrupt shoulders that would catch on the formation are avoided.

The outer shell may include outer coatings, paint, surface treatments, etc., as desired.

The inner body is formed of the first material, which is less durable than the materials of the outer shell. In one embodiment, inner body 19 is formed of a polymeric material, for example polyurethane, that rides easily over the surface of a wellstring tubular and causes minimal wear thereon. At least a portion of the axial bore is defined by the inner body. In one embodiment, at least a portion of axial bore 14 is a substantially cylindrical bearing surface formed by inner body and at least a portion of that axial bore is exposed for direct contact of the inner body against a tubular inserted through the axial bore. The casing is generally substantially smooth and tends not to tear at the polyurethane. The large and smooth bearing area provided by the inner body against the casing results in a distribution of forces such that a very low surface pressure (psi) is generated between the inner body and the casing.

The inner body may fill behind the outer shell such that gaps between the parts are avoided. For example, the material of the inner body may fill the indentations formed at inner surface 36 of the outer shell behind ribs 30. In one embodiment, inner body 19 and outer shell 20 may be bonded together where they come into contact so that they move and act together as a single part.

The centralizer may be formed in various ways. For example, the inner body may be formed in various ways and the outer shell may be applied thereover. Alternately, the outer shell, formed in various ways, may be provided and the inner body formed therein. It will be appreciated, for example, that the first material may be handled as by processes including molding, milling, forming, extrusion, etc. to form the inner body and the outer shell may be formed by liquid application over the inner body, the outer shell subsequently being allowed to set to a solid form. Alternately, the outer shell may be formed from a solid sheet or tubular form and shaped by pressing, hydroforming, explosive expansion, milling, etc.

In particular, the outer shell could be manufactured using several different methods. Because this is a consumable that has to be used in large quantities (perhaps 100 on a typical well) a manufacturing method that is economical, quick and flexible may be most useful. With reference to FIG. 2, one possible method is described that is flexible with regards to casing size, length and number, depth, form and orientation of ribs.

Figure 2A:
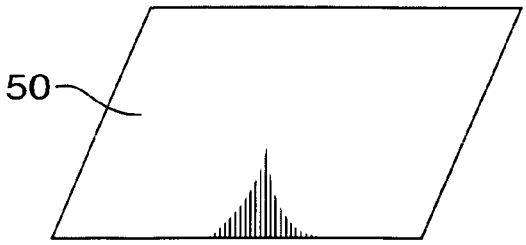
FIGS. 2A to 2H are schematic view of a series of steps to produce a centralizer according to various aspects of the present invention.
Figure 2B:
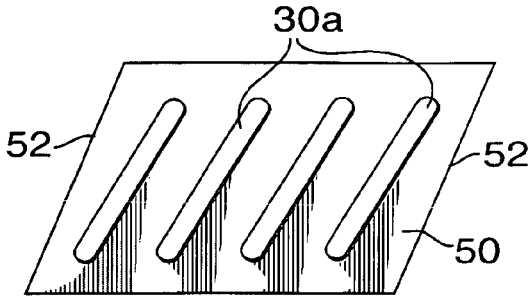
Figure 2C:
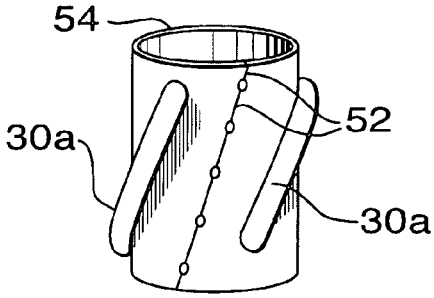
Figure 2D:
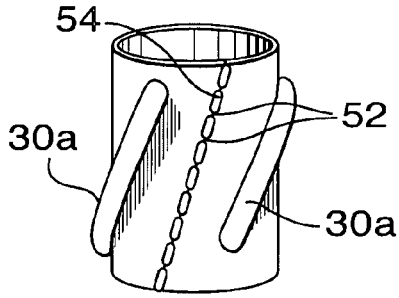
Figure 2E:
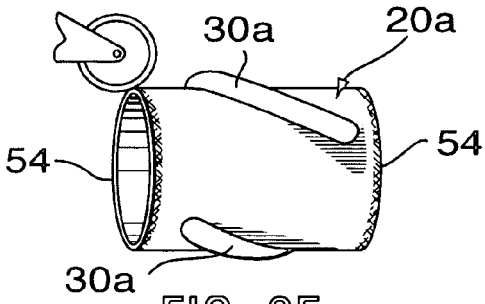

Sheet steel can be used to form the outer shell, since sheet steel is relatively inexpensive and generally always available. The sheet steel can be cut (FIG. 2A) into a member 50 having shape suitable for later rolling into a cylindrical form. Such a shape may for example be a parallelogram. In member 50, ribs 30*a* of various numbers, forms, depths and orientation can be formed using a press (FIG. 2B). Thereafter, as shown in FIG. 2C, member 50 can be rolled into a cylindrical form with ribs 30*a* protruding on the outer surface thereof. Care should be taken in any rolling process to avoid causing the ribs to be flattened out during rolling to bring the edges 52 together. Edges 52 can then be secured or fused together using an automatic welder or other means (FIG. 2D). Generally, cold rolled or low carbon steel is readily weldable without post weld heat treatment. If desired, as shown in FIG. 2E, end edges 54 of the steel shell may be roll formed to a shape that curves slightly in towards the centerline. Alternately, a ring can be attached to end edges 54. This will increase the strength of the edge, protect any polyurethane of the inner body positioned there beneath and increase the contact surface size of the steel edge against the casing coupler. At this point, outer shell 20*a* is formed and ready for further handling to form the final centralizer.

Of course, outer shell 20*a* could be manufactured by other processes such as by forming steel tubes, as by hydroforming, explosive expansion, pressing, etc. However, compared to operations using sheet steel and pressing of a flat starting material, some such process may be relatively more expensive to set up and may limit the flexibility of manufacture. In particular, once a form is made there may economically and technically be little flexibility to change the shape of the form, and thereby the centralizer. The same is true for injection molding and aluminum alloy casting. A "dimple rib forming" process may also be used and may offer some flexibility but may still offer little flexibility in the selection of tubular stock.

In one embodiment, the centralizer of FIG. 2 may be completed by molding.

Regardless of the method of forming, outer shell 20*a* may be used as a molding form for the material of the inner body. Some materials for use to form the inner body, such as polyurethane, offer convenient handling options. For example, unlike polymers requiring injection molding, which requires very high injection pressure (approximately 20,000-30,000 psi) and high strength expensive molds, polyurethane can be poured by hand at atmospheric conditions. It is believed that little expensive, complicated equipment is required to work with polyurethane. Polyurethane also may bond very well against steel.

Figure 2F:
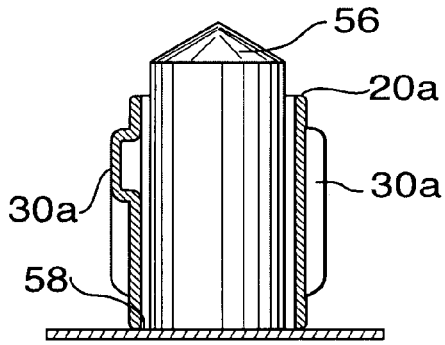

Thus, outer shell 20*a* may be installed in mold jig, as shown in FIG. 2F. The mold jig may include a central mandrel 56 about which the outer shell is positioned concentrically. Central mandrel 56 is shaped to form the axial bore 14*a* of the centralizer to be formed. The jig can include a structure for example an end wall 58 or annular plug to hold the liquid polyurethane in the mold.

Figure 2G:
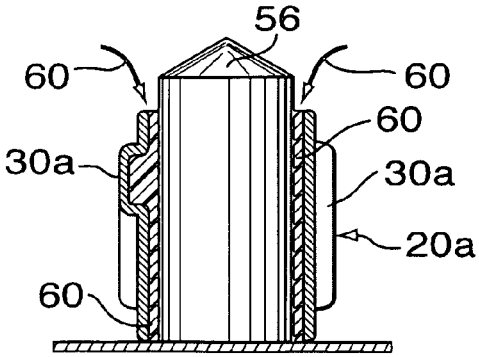
Figure 2H:
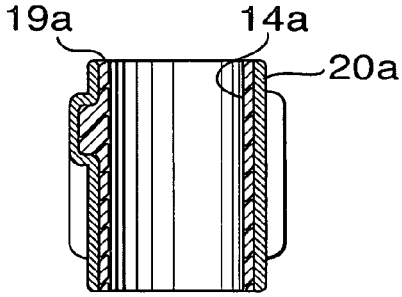

As shown in FIG. 2G, liquid polyurethane 60 may then be introduced, as by pouring at atmospheric conditions, between central mandrel 56 and outer shell 20*a*. The liquid polyurethane flows to fill the space between the outer shell and the mandrel and for example fills the indentations forming ribs 30*a*. Once the polyurethane is substantially set, FIG. 2H, the outer shell 20*a* and inner body 19*a*, formed from the hardened polyurethane, can be released from the mold jig. This leaves the final centralizer form, with the space left by removal of central mandrel forming axial bore 14*a*. The inner body is bound to outer shell 20*a* by the adhesive effect inherent through the polyurethane contact with the steel of the outer shell.

To install centralizer 10 on a tubular 28, the tubular is inserted through axial bore 14. In the case of use on a casing segment, the centralizer may be installed over an end on which a coupling 38 is not yet installed. Thus, in a casing application, the centralizer may be produced as a one-piece structure with inner bore 14 having an inner diameter ID substantially similar to the OD of the casing on which it is to be installed.

Although it may be useful to extend the more durable outer shell over substantially the entire outer surface of the body portion formed of the less durable first material, it may in some cases, for economic or weight reasons, be useful to limit the extension of the outer shell to areas about one or both ends of the centralizer; such that the centralizer includes one or more end bands positioned in the region at or between end edge and the highest point of the ribs. For example, with reference to FIGS. 3 and 4, another centralizer 110 is shown. Centralizer 110 includes a body with a bore 114 extending between a first end 116 and a second end 118. The first and second ends extend circumferentially defining openings to bore 114. The centralizer of FIGS. 3 and 4 may include many of the features of those centralizers of FIGS. 1 and 2, described above. For example, centralizer body may include a first portion 119 formed of a first material and an end band 121 may be secured at least in part to the first body portion 119 substantially encircling the bore and positioned adjacent at least one of the first end and the second end. The band may be formed of a second material more durable than the first material.

As will be appreciated, the centralizer may be formed to be retained over a well string tubular 128, such as drill pipe or casing including various kinds of tubulars, casing joints, liners, screens, etc. Centralizer 110 may be formed to be handled as one piece or may be formed in sections for eventual assembly to form the centralizer. In one embodiment, the body is continuous about the bore and the centralizer is retained over a wellbore tubular by insertion of the tubular through the bore. In the present embodiment, bore 114 closely engages against the wellbore tubular such that the centralizer is substantially non-rotating on the tubular to act against vibrationally induced damage to the centralizer.

Bore 114 is defined by an inner-facing surface of the body. An outer surface 132 can be defined opposite the inner facing surface. Such outer surface may include ribs, vanes, protrusions, inserts, hardening, etc., as desired, to control flow therepast or to select wear, bearing or spacing properties relative to the formation and/or borehole in which the centralizer is to be used. For example, the centralizer outer surface may be formed to provide positive standoff from the formation during use.

Since the band is intended to reinforce the end of the centralizer, the band may be formed of a second material more durable than the first material. The material of the end band, termed herein the second material, may have a hardness, strength, durability, or stiffness greater than the material of the first material, which is the material forming the centralizer body. The material properties of the second material and the first material, useful for the band and first body portion 119, respectively, are discussed herein above in detail.

A band may be used to reinforce one end of the centralizer and, if desired, a second band may be used to reinforce the opposite end of the centralizer, so that the centralizer resists deformation and damage at one or both of its ends. Each band 121 is formed to substantially encircle the long axis x of the centralizer, along which bore 114 extends, on the end on which it is installed. In one embodiment, the band may be continuous, as in the form of a ring such that it can completely encircle the bore of the centralizer. The band may be positioned adjacent the end of the centralizer for example at or near the end edge and may extend for any length up to the highest point of the ribs. The band may be, for example, exposed in part on the end or may be embedded entirely in the material of the body near the outer limit of the end in which it is installed. Since the band is of a material more durable than the material of the remaining centralizer body, it is desirable to position the band on or just below the surface of the first materials, so that it will immediately or soon be exposed to accept any impact forces directed against the centralizer at its ends.

Figure 3:
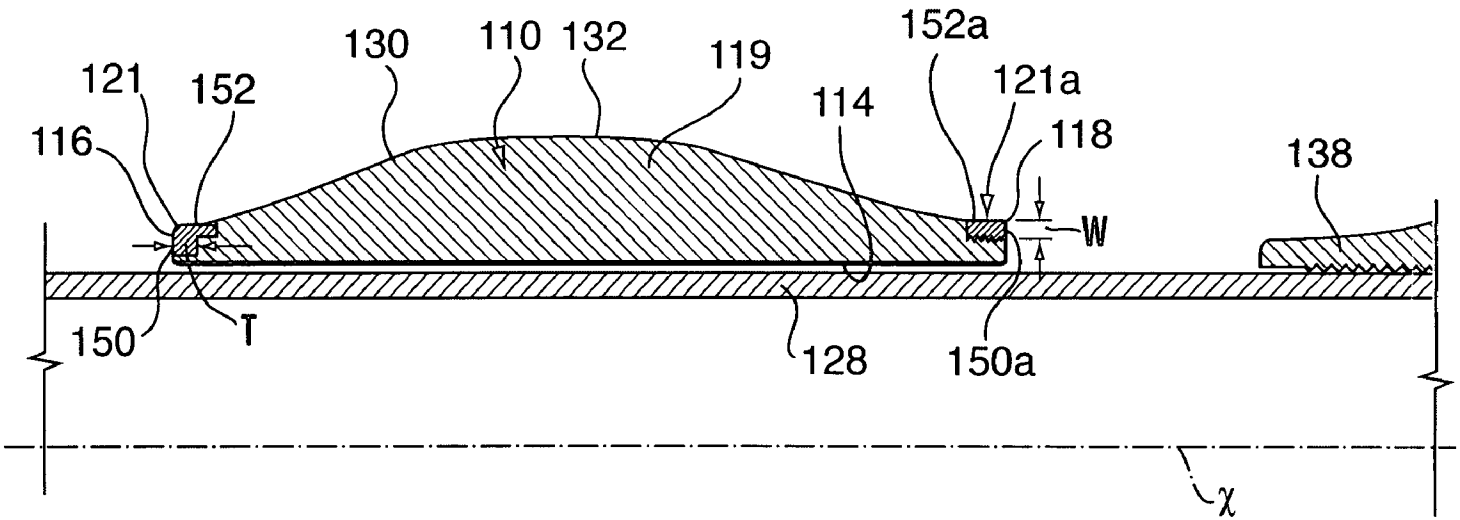
FIG. 3 is a quarter sectional view through another centralizer according to another aspect of the present invention on a well string tubular.
Figure 4:
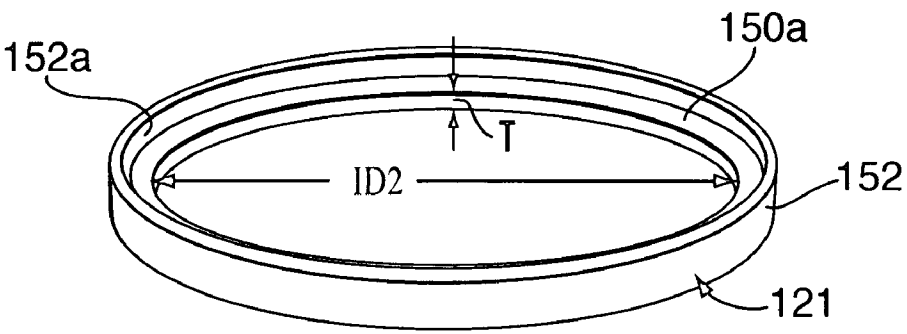
FIG. 4 is a top perspective view of a ring useful in a centralizer according to one aspect of the present invention.

In the embodiment illustrated in FIGS. 3 and 4, band 121 may include a continuous (as shown) or segmented annular end wall 150 and a continuous (as shown) or segmented annular outer wall 152. An end wall 150*a* can have a length equal to the thickness of outer wall 152*a*, as shown on band 121*a* at end 118. Alternately an end wall 150 can have a length such that it extends radially inwardly from outer wall 152 (see end 116). In such an embodiment, walls 150, 152 abruptly or gradually angularly offset from one another such that band 121 defines a generally "L" shape outer surface (ranging from an acute to obtuse angle between the sides). If end wall 150 extends out beyond the outer wall, the band may define an "L" shaped structure in radial section (as shown in FIG. 3).

When installed on a centralizer body, at least a portion of inner surface 152*a* of outer wall 152 overlies the material forming body 112 and wall 150 is accessible at the end edge of the centralizer. Band 121 thereby protects and reinforces against both axially directed forces and some laterally directed forces against the end and a portion of the outer surface of the centralizer adjacent the end.

When installed, end wall 150 is positioned adjacent the end of the centralizer body around the opening to the bore. During wellstring handling and use, much damage can occur where the centralizer impacts against a shoulder, such as that formed by a coupling 138 on the casing. It is, therefore, desirable to form the band to protect first body portion 119 against such direct axial impact. Thus, the band may be formed and positioned on the centralizer with consideration as to size and position of any casing shoulders against which a centralizer is likely to come into contact. In an application where the centralizer is used on a wellbore casing string, a shoulder is formed at the coupling 138 end face. In one embodiment, the band is selected to include an inner diameter ID2 at its end wall which is less than the outer diameter of the coupling so that the band overlaps at least in part with the coupling. In this way, should the centralizer during use come into contact with coupling 138, the band can take up the force of that contact and prevent or reduce damage to first body portion 119. Of course, if the first body portion extends out axially beyond the band, the band will only come into contact with the coupling once the material of the body 119 is worn away, but thereafter the band will resist further degradation of the inner body from impact against the coupling. The sizes of casing and their corresponding couplings are controlled by the API Specifications (API Specification 5CT, Sixth Edition, October 1998), as noted previously, and centralizers can be formed accordingly.

End wall 150 may have a width w equal to or greater than the thickness of the centralizer at its ends or, if it is desired to space the end ring from contact with the wellbore tubular on which the centralizer is installed (as shown), the end wall may have a width less than the thickness of the centralizer body at its end. Stated another way, the inner diameter ID2 of end wall 150 may be greater than the inner diameter of bore 114 if it is desired to space the band from contact with tubular 128. End wall 150 may be exposed or embedded in the first material forming the centralizer body. End wall 150 may be frustoconically formed on its inner-facing 150*a* or its outer-facing surfaces 150*b* or may be substantially planar on one or both of those surfaces.

Outer wall 152 extends back from the end wall along the centralizer outer surface 132. The outer wall can be exposed on the outer surface of the centralizer or may be buried just below the material forming the outer facing surface of the polymeric body of the centralizer. The outer wall can be frustoconically formed on its inner surface 152*a* or its outer surface or may be cylindrical on one or both of those surfaces. The outer wall may be of various lengths. It is noted that a centralizer body may be formed, as shown, to taper from a thicker mid section, for example, that portion on which ribs 130 are formed, toward the ends 116, 118. Such tapering eases movement of the centralizer past ledges and discontinuities in the wellbore. Of course, the tapered ends may be more susceptible to damage during use than the thicker mid section, a factor of their relative thickness. Thus, it may be useful to extend outer wall 152 a distance from the centralizer end to a position covering the tapered end portions adjacent or overlapping the edge of mid section. For example, outer wall 152 may extend at least to the base of where vanes begin to protrude from outer surface 132. An appropriate length may be determined by studying the locations of body damage from experimental plastic centralizers or those recovered after borehole use.

End band 121 is positioned to protect the end of the centralizer from the damage that may occur by being forced against ledges in the borehole, raised portions on the tubular such the casing coupling 138, etc. End band 121 is formed, considering the relative positioning of the outer wall and end wall 150 with the end wall extending inwardly from the outer wall and the outer wall extending along the outer surface of the centralizer, such that any deformation of the centralizer by forces thereagainst, will tend to direct and force the centralizer body radially inwardly against the casing. This tends to prevent the weaker and/or softer materials of the centralizer first body portion 119 from creeping and riding over the centralizer end band and beyond that over raised portions on the well string, such as coupling 138, which may cause the centralizer body to break apart.

The thickness of the band walls 150, 152 should be selected with consideration to the material of the band and its wear properties to be able to withstand wear and tear, substantially without complete destruction thereof. For example, the material may be able to withstand to some degree, impact and wear for periods of time normally encountered for use of a drill string and/or for running or drilling in a liner string without the band completely wearing through, or at least without complete failure/removal thereof. In one embodiment, the band walls may be 1/16 inch to 1/2 inch thick. The thickness of outer wall 152 is limited by the available diametrical space about the tubular and relative to the maximum diameter generated about any shoulders on the tubular. Thus, in one embodiment, the thickness of outer wall in one embodiment may be about 3/32 to 1/4 inch thick. It has been found that end wall 150 may experience more constant wear than outer wall 152, thus, it may be desirable to form end wall 150 thicker, as shown at T, than outer wall. As such, end wall 150 may be able to withstand greater wear than the outer wall before any risk of failure thereof.

Centralizer 110 may be formed in various ways, as noted above with respect to the embodiment of FIGS. 1 and 2. For example, body portion 119 can be formed by milling, molding, extrusion, etc. Band 121 may be installed on centralizer body by interlocking, engaging or adhesion between the parts, with or without additional features to enhance chemically or by physical engagement therebetween. Band 121 can be installed after the body portion 119 is formed or can be placed during molding of body portion 119 to be engaged thereto in the finally formed body. One or more end bands may be positioned in a jig for incorporation into a centralizer body formed of polymer. The end bands may be positioned in a jig by various means including by magnetic positioning, retainers, etc.

In one embodiment, the outer wall inner surface 152*a* may include surface roughening, thread forms, teeth, returns, etc. to permit interlocking engagement of the band to body 119, with or without also relying on adhesion between the parts.

Of course it is to be understood that although the embodiments of FIGS. 1, 2 and 3 have been described together in this document, they can be used separately or together in various combinations.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A wellstring assembly comprising:

first and second tubular casing members, each having a threaded end;

a coupling having an outer diameter greater than the casing members that secures the threaded ends of the casing members together, the coupling defining a shoulder on one end;

a tubular device including a bore therethrough, the tubular device installed on the first casing member with the first casing member extending through the bore, the tubular device comprising:

an outer shell having an exterior surface with a plurality of ribs extending radially outwardly from the exterior surface of the outer shell, the outer shell having an interior surface with recesses opposite and in conformity with the ribs, the outer shell being of uniform thickness and formed entirely of a sheet of steel;

a body located within the shell and having an exterior surface that is in contact with and in conformity with the interior surface of the shell, including the recesses, without any gaps between the exterior surface of the body and the interior surface of the shell, the body having a first end and a second end, the first and second ends extending circumferentially about the bore, the bore being in physical contact with and axially slidable on an exterior surface of the casing member relative to an axis of the casing member;

the body being formed entirely of a polymer; and the outer shell having first and second ends, each having an inner diameter smaller than an outer diameter of the shoulder of the coupling so as to abut the shoulder in the event the body and the shell move axially on the first casing member a sufficient distance.

2. The wellstring assembly of claim 1 wherein the polymer material includes polyurethane.

3. The wellstring assembly of claim 1 wherein the exterior surface of the body is bonded to the interior surface of the outer shell.

4. The wellstring assembly of claim 1 wherein the first end of the outer shell is flush with the first end of the body, and the second end of the outer shell is flush with the second end of the body.

* * * * *